US005986405A

United States Patent [19]

De Maagt et al.

[11] Patent Number: 5,986,405

[45] Date of Patent: Nov. 16, 1999

[54] HIGH PRESSURE DISCHARGE LAMP

[75] Inventors: Bennie J. De Maagt, Eindhoven, Netherlands; Claudio Boffito, Milan, Italy

[73] Assignee: U.S. Philips Corporation, New York, N.Y.

[21] Appl. No.: 08/976,521

[22] Filed: Nov. 21, 1997

[30] Foreign Application Priority Data

Nov. 22, 1996 [EP] European Pat. Off. ..... 96203226

[51] Int. Cl.[6] ..... H01J 17/20; H01J 61/12; H01J 1/02; H01J 7/24

[52] U.S. Cl. ..... 313/637; 313/25; 313/546; 313/551; 313/562; 313/563; 313/634

[58] Field of Search ..... 313/17, 25, 26, 313/493, 545–46, 549–51, 553, 554, 555–56, 558–560, 561–62, 563–64, 567, 573, 634–637; 445/58

[56] References Cited

U.S. PATENT DOCUMENTS 4,499,396 2/1985 Fohl et al. .
4,559,471 12/1985 Kroonjte ..... 313/553
4,918,352 4/1990 Hess et al. .

*Primary Examiner*—Nimeshkumar D. Patel
*Assistant Examiner*—Mack Haynes
*Attorney, Agent, or Firm*—F. Brice Faller

[57] ABSTRACT

The high pressure discharge lamp has a discharge vessel (1) mounted in an outer envelope (4) in which an oxygen dispenser (30) is disposed. The oxygen dispenser (30) contains silver oxide and may be disposed at a location where it obtains a temperature of at least 340° C. during operation of the lamp, at which temperature the oxide is decomposed and oxygen is released. The deposit of black coatings originating from hydrocarbon contaminations is thereby prevented.

7 Claims, 3 Drawing Sheets

HIGH PRESSURE DISCHARGE LAMP

BACKGROUND OF THE INVENTION

The invention relates to a high pressure discharge lamp comprising:

- a light-transmitting discharge vessel, which is sealed in a gas-tight manner, which has an ionizable gas filling and in which discharge electrodes are present, connected to current supplies entering the discharge vessel;
- a light-transmitting outer envelope, which is sealed in a gas-tight manner and which surrounds the discharge vessel;
- current conductors entering the outer envelope and being connected to a respective current supply;
- an oxygen dispenser containing an oxygen compound disposed in the outer envelope, to release oxygen into the outer envelope upon the oxygen compound being decomposed by heat.

Such a high pressure discharge lamp is known from U.S. Pat. No. 4,918,352.

The known lamp has in the outer envelope either an oxygen containing gas filling or an oxygen dispenser, which releases oxygen by heat evolved upon the lamp being switched on. According to said patent specification said measure is taken to oxidize the surface of the current conductors and thereby to prevent the loss of sodium from the gas filling of the discharge vessel.

It is a disadvantage of gaseous oxygen being present inside the outer envelope immediately after completing the lamp manufacture, that the gas-tightness of the outer envelope can not be verified by generating a glow discharge inside the outer envelope. So, an oxygen dispenser would be advantageous, which releases oxygen only upon being heated after the gas tightness of the outer envelope has been verified. The said patent specification does, however, unfortunately not mention any oxygen compound pound which could be used for said purpose.

From U.S. Pat. No. 4,499,396, it is known to be advantageous to have a slightly oxidizing gas filling in the outer envelope due to the presence of a trace of oxygen, in order to prevent a phosphor coating on the inside surface of the outer envelope to become reduced and as a result to become blackened. Blackening causes a decrease of the luminous maintenance of the lamp. The presence of oxygen gas in the outer envelope immediately after the completion of the lamp manufacture to prevent this, is a disadvantage, however.

Nevertheless, there is a strong felt need to obviate blackening of the outer envelope of high pressure discharge lamps. Such blackening may occur as a result of hydrocarbons being present in the outer envelope. Already during the first hours of operation of lamps hydrocarbons are decomposed to give carbon which deposits as a black layer on the outer envelope and/or the discharge vessel. A black layer does not influence the luminous maintenance, only, but also the temperature of the discharge vessel, which may result in a color shift. As these deposits occur within a few hours of operation already, they have a long lasting negative effect on the properties of lamps. So, it is highly desirable to combat the occurrence of carbon deposits as fast as is possible.

Hydrocarbons in lamps may originate from several sources. They may have been introduced into the outer envelope as contaminations on lamp parts, e.g. on its current conductors, or originate from the oil in the vacuum pump used to evacuate the outer envelope, eventually prior to it being filled with inert gas, such as e.g. $Ne/N_2$. They also may be a residue of a binder, e.g. a binder used to bring about a coating, such as a heat conserving coating, such as a coating of zirconium oxide, on end portions of the discharge vessel, or a binder to make a phosphor coating. Apart from causing a black deposit which hampers the transmission of light and reduces the luminous maintenance, and which possibly causes a color shift, carbon originating from hydrocarbons may reduce the phosphor coating, if present, causing the coating to blacken and making the coating less effective.

APL Engineered Materials, Inc, of Illinois U.S.A. discloses in its Product Development Information Bulletin: Metal Halide Lamp Getter, of Dec. 1, 1989, a metal halide lamp being provided in its outer envelope with a stainless steel case having a porous cover and containing a disc of barium peroxide disposed at a temperature of between 200 and 360° C. The getter maintains a slightly oxidizing atmosphere within the outer envelope. This is said to be particularly advantageous for lamps that are sensitive to hydrocarbon contamination, such as lamps with a phosphor coated outer envelope.

$BaO_2$ as an oxygen generator in an oxygen dispenser was found to be of little value. $BaO_2$ releases oxygen that reacts with hydrocarbons according to the following reactions:

$$BaO_2 \rightarrow BaO + \tfrac{1}{2}O_2 \quad \text{(I)}$$

$$C_nH_{m+}(n+\tfrac{1}{4}\,m)O_2 \rightarrow n\,CO_2 + (m/2)\,H_2O \quad \text{(II)}$$

The use of $BaO_2$ has, however, some technical drawbacks.

First, $BaO_2$ reacts with hydrogen, generally present in lamps, according to the reaction:

$$BaO_2 + H_2 \rightarrow Ba(OH)_2 \quad \text{(III)}$$

The use of $BaO_2$ in lamps had been originally proposed by U.S. Pat. No. 3,519,864, with the very aim of absorbing hydrogen which has negative effects on the discharge voltage in the discharge vessel.

Thus formed $Ba(OH)_2$, in turn, may decompose according to the reaction:

$$Ba(OH)_2 BaO + H_2O \quad \text{(IV)}$$

which reaction is undesirable.

Moreover, reactions (I), (III) and (IV) may take place simultaneously, thus making difficult an exact dosing of $BaO_2$. Dosing is made even more complicated by the fact that the rate of these reactions have a different temperature dependency. To obviate this problem, APL commercial bulletin states that $BaO_2$ container positioning inside the lamp must be such that $BaO_2$ is kept at a temperature comprised between about 250 and 360° C. $BaO_2$ should be best kept below 325° C. That is, however, all but easy to realize, as the temperature profile inside the lamp depends in a complex way on factors such as working position: horizontal, vertical or any intermediate position, and dimensions and constituting materials of possible lamp housings.

Finally, the oxygen release rate of $BaO_2$ is high only at temperatures in excess of 500° C., so that the maximum allowed temperature of 360° C. is against the request of a rapid release of oxygen at the beginning of lamp life.

SUMMARY OF THE INVENTION

It is an object of the present invention to provide a high pressure discharge lamp of the kind described in the opening paragraph having an oxygen dispenser which provides a fast oxygen release at relatively low temperatures.

This object is achieved in that the oxygen dispenser contains $Ag_2O$.

Silver oxide was found to be very much effective in obviating the negative effects of the presence of hydrocarbons in the outer envelope of the high pressure discharge lamp. The compound gives at relatively low temperatures a quick release of oxygen according to the reaction:

$$Ag_2O \rightarrow Ag\ \tfrac{1}{2}O_2 \qquad (V)$$

Oxygen release starts at a temperature of about 300° C., only. As a consequence it is possible to complete the manufacture of the lamp securely without oxygen being released. Thereby, the gas-tightness of the outer envelope can be verified by means of a glow discharge, as is desirable. On the other hand, however, silver oxide shows an accelerated oxygen release at a temperature of about 340° C. and a very fast release at about 400° C. This is apparent from curve 1 of FIG. 5 showing the weight loss, Δ weight, of a sample which was heated from ambient temperature to a temperature of 400° C. is represented as a function of the time. At 400° C., the decomposition of $Ag_2O$ is complete within 20 minutes. It appears that there is a relatively wide temperature range at a relatively low level: about 340 to about 400° C., in which silver oxide is active as an oxygen generator. At and above 400° C. the release is fast. This property allows for a variety of locations in which the oxygen dispenser may be mounted, particularly substantially outside the path of the light generated by the discharge during operation of the lamp, in order to have the oxygen dispenser activated by heat evolved by the discharge. In this respect light is meant to mean visible light as well as UV light. So, the oxygen dispenser does not need to intercept substantially any light directly from the discharge.

The small weight loss which occurs from about 150° C. is due to carbon dioxide, and to a lesser extent to water. As it is seen from curve 2 of FIG. 5, $BaO_2$ shows a similar small weight loss due to the release of contaminants up to a temperature of 400° C., without substantially any oxygen being released.

The freedom of choice of a location for the oxygen dispenser is even further increased by the fact, that oxygen can be released by means of an activating step after lamp manufacture is completed, but prior to first lamp operation. The activation may be performed by heating the dispenser with an external heat source, e.g. by means of an HF electromagnetic field, a laser, or other suitable heating means.

It is an advantage of the silver oxide oxygen dispenser that it can be stored during relatively long time, at least for ten days, in the air at room temperature substantially without noticeable effect on its favorable properties in the lamp. Moreover, the silver residue of the dispenser resulting from reaction V is inert to the lamp atmosphere, which is in contrast to the products formed by reactions III and IV.

The oxygen dispenser may be located adjacent a seal of the discharge vessel or e.g. in line with the discharge vessel, e.g. mounted to a current conductor.

The amount of silver oxide in the dispenser is not critical. The amount may be influenced by the dimensions of the lamp, its production process, and the presence of coatings inside the outer envelope. The amount needed for each type of lamp can easily be determined in a few experiments. An excess amount will generally not harm the quality of the lamp, as excess oxygen will become bound e.g. by superficial oxidation of the current conductors. According to the U.S. Pat. No. 4,918,352 cited, this would have a favorable effect in lamps having sodium in the discharge vessel. Generally, the amount of silver oxide may be chosen such, that its oxygen content is between about 0.5 and 3.3% by volume of the gas filling of the outer envelope, if present, or that it generates upon decomposition an initial partial oxygen pressure of about 5 to about 20 mbar.

It is of no importance to the essence of the invention what shape the outer envelope has, whether it is tubular or e.g. ovoïdal in shape, and whether it is single or double ended, provided with one or more caps or not, whether it is of glass, e.g. quartz glass or hard glass, or of any other light transmitting material. The discharge vessel may be of e.g. quartz glass or of mono- or polycrystalline material, like e.g. sintered alumina. The discharge vessel may have one of a variety of shapes and e.g. be tubular, and be single or double ended. Its gas filling may comprise noble gas, possibly mercury, possibly metal halides, such as bromides and/or iodides, or e.g. sodium amalgam. The outer envelope may be evacuated or be filled with gas, e.g. with a mixture of $Ne/N_2$. Generally, the outer envelope will accommodate a hydrogen getter to avoid that hydrogen released by contaminations upon their decomposition, diffuses into the discharge vessel and thereby increases the ignition voltage.

The physical form of $Ag_2O$ is not relevant for the performance of the oxygen dispenser, and $Ag_2O$ could in principle be employed in the form of extremely fine powders, with grains of dimensions of a few tens of nanometers up to dimensions of millimeters. However, for practical reasons concerning the production of the oxygen dispenser, it is preferred to employ powders with grain dimensions in the range of about 0.1 to about 50 $\mu$m.

The oxygen dispenser may have a container which may be made of various metals, such as stainless steel, nickel, titanium. For reasons of ease of working, the use of nickel plated iron or nickel chromium alloys is preferred. The container may have any geometrical shape. Examples are shown in the drawings.

In an embodiment of the oxygen dispenser, the container is shaped from metal tape. The tape may be formed into an e.g. U-shaped channel, into which silver oxide powder is introduced. The channel may then be worked to obtain an e.g. foursided closed sleeve, which has a longitudinal slit of abutting or overlapping edges of the original metal tape to allow for oxygen passage, later on. The sleeve may be cut at desired lengths, depending on the amount of silver oxide to be present in the lamp. Simultaneously with, or alternatively after, the cutting operation the sleeve may be squeezed to make a closure at the end face obtained on cutting. Alternatively, a closure may be obtained e.g. by means of a separate cap.

In the case the outer envelope accommodates a hydrogen getter, such as e.g. $Zr_2Ni$, the oxygen dispenser and the getter may be integrated. So, a common body, e.g. a common piece of metal, may carry both the getter and silver oxide. Silver oxide and the getter may, for instance, be present in a common recess of the body. They may even be present as an admixture. A common carrier, and also the use of an admixture, lowers the costs of manufacturing the getter and the oxygen dispenser, and the costs of assembling the lamp.

BRIEF DESCRIPTION OF THE DRAWINGS

An embodiment of the high pressure discharge lamp according to the invention is shown in the drawings, in which.

DESRIPTION OF THE PREFERRED EMBODIMENTS

Figure 1:
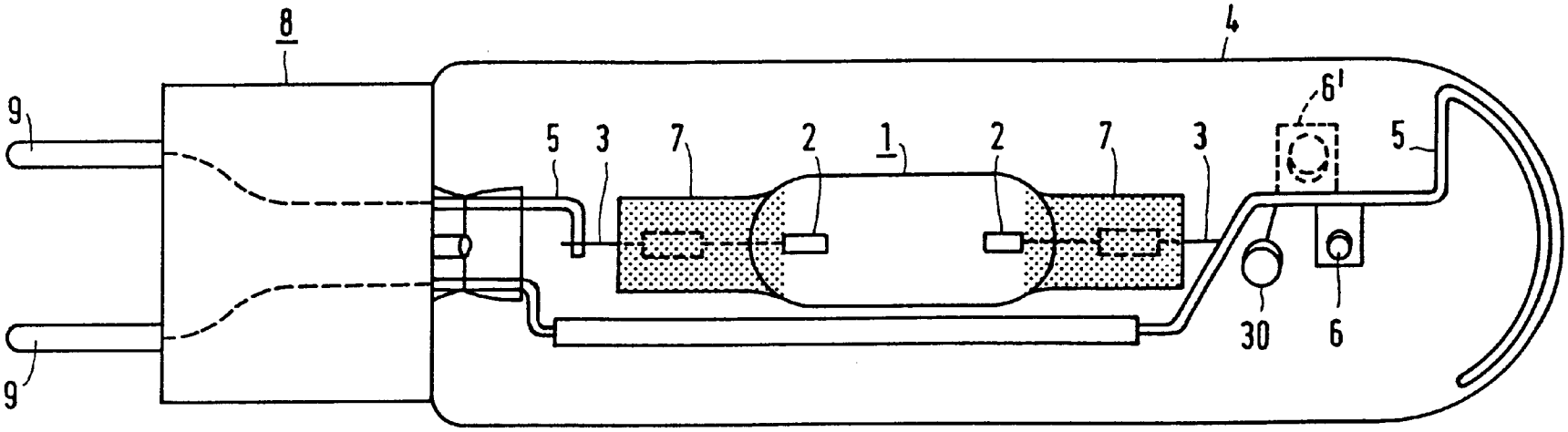
FIG. 1 represents the lamp in side elevation.

The high pressure discharge lamp of FIG. 1 has a light-transmitting discharge vessel 1, which is sealed in a gas-tight manner and which has an ionizable gas filling. Discharge electrodes 2, in the Fig. of tungsten, are present therein, connected to current supplies 3 which enter the discharge vessel 1. In the Fig. the discharge vessel 1 is made of quartz glass and has a gas filling of rare gas, mercury and the iodides of sodium, indium and thallium. End portions 7 of the discharge vessel 1 in the Fig. have a heat conserving coating of $ZrO_2$.

Figure 4:
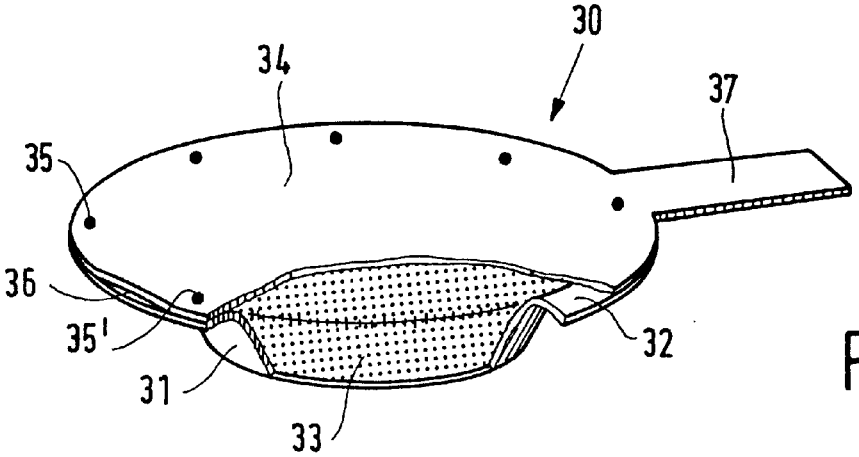
FIG. 4 a third embodiment of the oxygen dispenser.
Figure 5:
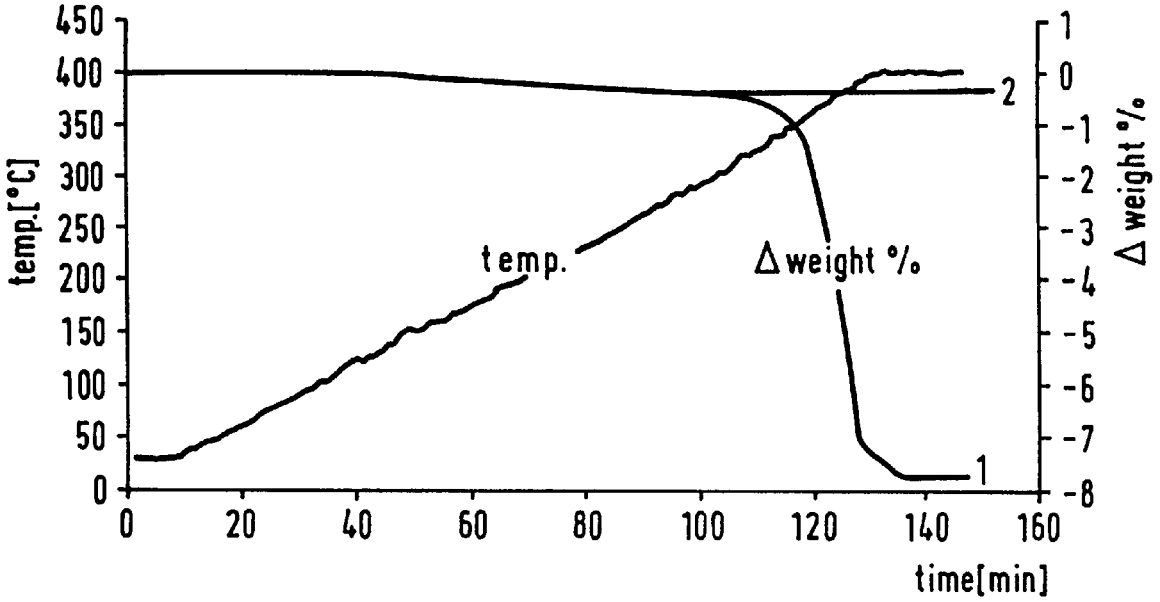
FIG. 5 a graph showing the oxygen release by the oxygen dispenser.

A tubular light-transmitting outer envelope 4, in the Fig. of hard glass, which is sealed in a gas-tight manner, surrounds the discharge vessel 1. Current conductors 5 enter the outer envelope 4 and are connected to a respective current supply 3. An oxygen dispenser 30 as shown in FIG. 4 and containing an oxygen compound is disposed in the outer envelope, to release oxygen into the outer envelope 4 upon the oxygen compound being decomposed by heat. A hydrogen getter 6 is disposed in the outer envelope 4, too. In the Fig. a Saes PH/SF 50 getter is used. Said getter contains $Zr_2Ni$ as the active ingredient. In the Fig. the oxygen dispenser 30 and the getter 6 are mounted in line with the discharge vessel, welded to a current conductor 5. The outer envelope 4 is secured to a cap 8, to contacts 9 of which a respective current conductor is connected.

The oxygen dispenser 30 contains $Ag_2O$ as oxygen releasing compound.

The oxygen dispenser 30 is disposed in a location where it obtains during operation of the lamp a temperature of at least 340° C., in the Fig. about 400° C. So, in the lamp shown in FIG. 1, oxygen is rapidly released upon the oxygen dispenser being heated by heat evolved by the operating lamp.

The oxygen dispenser 30 comprises a container 31,34 open to oxygen in which 60 mg of Ag $O_2$ is present in powdery form.

The lamp shown consumes a power of 250 W. Its outer envelope has a volume of about 310 ml and is filled with 600 mbar $Ne/N_2$ mixture.

In a modification of the lamp of FIG. 1, the oxygen dispenser 30 and the getter were integrated, so as to constitute one body accommodated adjacent the location of the oxygen dispenser 30 in FIG. 1. In a further modification the container 31,34 contained both the getter and silver oxide. In a still further modification the $Zr_2Ni$ getter and oxygen oxide were present in admixture in a carrier 6', indicated in dashed lines in FIG. 1.

Figure 2:
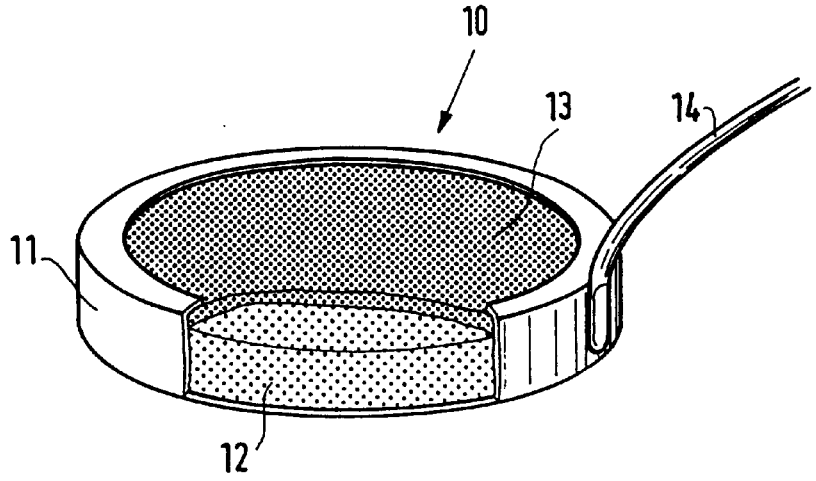
FIG. 2 a first embodiment of the oxygen dispenser.

In FIG. 2, the oxygen dispenser 10 comprises a cylindrical container 11, which is open at its top and which contains silver oxide in the form of loose or compressed powder 12. The top is closed by an element 13, capable of retaining powder and allowing the free passage of gas, e.g. a disk made of sintered metal powder. A support 14 is fixed to the container 11 for steady positioning the dispenser 10 inside a lamp.

Figure 3:
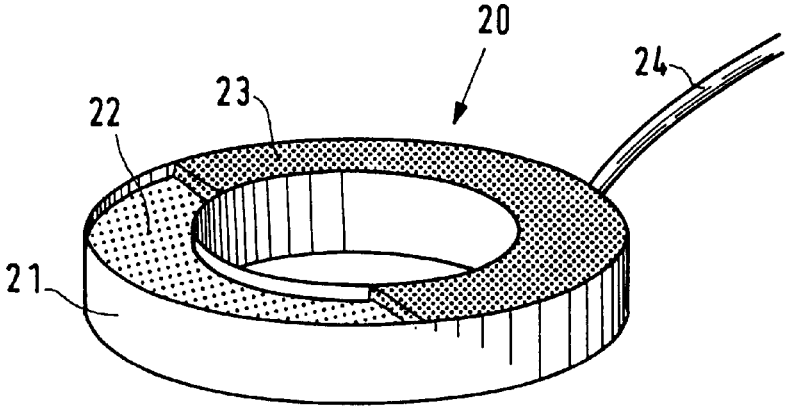
FIG. 3 a second embodiment of the oxygen dispenser.

In FIG. 3, the oxygen dispenser 20 comprises an annular container 21, which is loaded with silver oxide powder 22. The powder 22 is retained in the container 21 by a metallic element 23, capable of allowing the free passage of gas. A support 24 is fixed to the container 21 for securing the dispenser 20 inside a lamp.

The dispenser 30 of FIG. 4 comprises a concave container 31, obtained by cold forming a metal foil. The container 31 has a straight upper edge 32. In the concave portion of container 31 silver oxide 33 is placed. The upper side of the container 31 is closed by a retaining element 34 constituted by an impermeable metal foil, which is fixed to edge 32 by means of a plurality of weldings, for instance with spot weldings 35, 35'. The container is powder-proof, but allows an easy escape of oxygen gas through slits 36, only one of which is shown in the drawing, remaining between edge 32 and element 34, between each two spot weldings. The element 34 has a tongue 37 for fixing the dispenser 30 in a lamp.

Lamps of the kind shown in FIG. 1 were made without the oxygen dispenser (Ref. Lamp), with a fresh oxygen dispenser kept in inert gas up to the step of it being mounted in the lamp (FD Lamp), with an aged dispenser, kept at least 72 hours in the ambient atmosphere prior to mounting (AD Lamp), with intentionally dosed oil in the outer envelope but without oxygen dispenser (O Lamp), and with intentionally dosed oil and with a fresh oxygen dispenser (OFD Lamp). The oxygen dispensers contained in these test lamps 115 mg of $Ag_2O$.

The said lamps were operated and measured as soon as stable operation was obtained, 15 min. after ignition, the 0 hrs point of time. The lamps were measured again after 100 hours of stable operation. The luminous output and the x coordinate of the color point in the color triangle were determined. Because the gas filling of the discharge vessel contains sodium iodide, an increase of the temperature of the discharge vessel due to a heat accumulating black deposit results in a larger amount of sodium in the discharge arc, and thereby in a higher x coordinate. A low x value is an indication of the absence of a black deposit. The data mentioned and the calculated luminous maintenance at 100 hrs, the luminous flux at that time expressed as a percentage of the luminous flux at 0 hrs of stable operation, are mentioned in Table 1.

TABLE 1

| Lamps | | 0 hrs | 100 hrs | lum. main. (%) |
|---|---|---|---|---|
| Ref. | lm | 19640 ± 270 | 17680 ± 520 | 90.0 |
| | x | 356 ± 3 | 368 ± 5 | |
| FD | lm | 20140 ± 345 | 19640 ± 380 | 97.5 |
| | x | 360 ± 4 | 355 ± 5 | |
| AD | lm | 20500 ± 455 | 19950 ± 330 | 97.3 |
| | x | 360 ± 4 | 357 ± 1.5 | |
| O | lm | 17470 ± 1140 | 12730 ± 2090 | 72.9 |
| | x | 368 ± 9 | 380 ± 8 | |
| OFD | lm | 18955 ± 970 | 19435 ± 555 | 102.5 |
| | x | 363 ± 6 | 358 ± 4 | |

It is seen by comparing the results of the Ref. Lamps with those of the FD and the AD Lamps, that the oxygen dispenser provides a considerably increased luminous maintenance, it being without significant effect whether the dispenser is fresh or aged. The detrimental influence of hydrocarbons is best seen from the O Lamps. From the last lines of Table 1 it is clear, that the oxygen dispenser is perfectly capable of obviating that detrimental effect of even intentionally added oil, (OFD Lamp). The x coordinates of the color points at 100 hrs, which are lowest in lamps having an oxygen dispenser, too, indicate that the deposition of a heat accumulating coating is obviated.

It appeared from analysis of the gas in the outer envelope after 2000 hours of operation, that lamps having the oxygen dispenser contain carbon dioxide, but no hydrogen. The capability of the hydrogen getter is not hampered by the oxygen release. Carbon dioxide will be slowly absorbed by the getter, but is not detrimental to the lamp.

We claim:

1. A high pressure discharge lamp comprising:

a light-transmitting discharge vessel (1), which is sealed in a gas-tight manner, which has an ionizable gas filling and in which discharge electrodes (2) are present, connected to current supplies (3) entering the discharge vessel (1);

a light-transmitting outer envelope (4), which is sealed in a gas-tight manner and which surrounds the discharge vessel (1);

current conductors (5) entering the outer envelope (4) and being connected to a respective current supply (3);

an oxygen dispenser (30) containing an oxygen compound disposed in the outer envelope, to release oxygen into the outer envelope (4) upon the oxygen compound being decomposed by heat, wherein the oxygen dispenser (30) contains $Ag_2O$.

2. A high pressure discharge lamp as claimed in claim 1 wherein the oxygen dispenser (30) is disposed in a location where it obtains during operation of the lamp a temperature of at least 340° C.

3. A high pressure discharge lamp as claimed in claim 1 wherein the outer envelope (4) accommodates a hydrogen getter (6).

4. A high pressure discharge lamp as claimed in claim 3 characterized in that the hydrogen getter (6) comprises $Zr_2Ni$.

5. A high pressure discharge lamp as claimed in claim 1, wherein the oxygen dispenser (30) comprises a container (31,34) open to oxygen in which $AgO_2$ is present in powdery form.

6. A high pressure discharge lamp as claimed in claim 3 wherein silver oxide and the hydrogen getter are held by one common carrier (6').

7. A high pressure discharge lamp as claimed in claim 6 wherein silver oxide is present in admixture with the hydrogen getter.

* * * * *